United States Patent [19]

Moore et al.

[11] Patent Number: 4,860,876

[45] Date of Patent: Aug. 29, 1989

[54] ARTICLE VENDING MACHINE EMPLOYING UNIQUE ROBOTIC ARM AND THE ROBOTIC ARMS EMPLOYED THEREIN

[75] Inventors: William A. Moore, Easton; Constantine F. Economy, Allentown; Theodore F. Economy, Orefield, all of Pa.

[73] Assignee: Midway Video, Ltd., Wilkes-Barre, Pa.

[21] Appl. No.: 84,259

[22] Filed: Aug. 11, 1987

[51] Int. Cl.[4] ..... G07F 11/54; G07F 7/08

[52] U.S. Cl. ..... 194/205; 221/79; 221/88; 221/259; 414/278; 414/787

[58] Field of Search ..... 194/205, 350; 221/79, 221/80, 81, 87, 88, 120, 121, 122, 210, 218, 259; 186/55, 56, 57, 58; 414/331, 273, 277, 278, 280, 787, 281, 282; 235/380, 381, 383, 385

[56] References Cited

U.S. PATENT DOCUMENTS

| | | | |
|---|---|---|---|
| 3,456,817 | 7/1969 | Irazoqui | 221/79 X |
| 4,348,152 | 9/1982 | Takamatsu | 414/273 X |
| 4,389,157 | 6/1983 | Bernard, II et al. | 414/280 X |
| 4,458,802 | 7/1984 | Maciver et al. | 194/205 |
| 4,519,522 | 5/1985 | McElwee | 221/79 X |
| 4,561,820 | 12/1985 | Matheny, III et al. | 414/331 |
| 4,563,120 | 1/1986 | Josserand | 414/280 X |
| 4,668,150 | 5/1987 | Blumberg | 414/273 |
| 4,734,005 | 3/1988 | Blumberg | 221/88 X |

FOREIGN PATENT DOCUMENTS

| | | | |
|---|---|---|---|
| 0060643 | 9/1982 | European Pat. Off. . | |
| 0184527 | 6/1986 | European Pat. Off. . | |
| 0191636 | 8/1986 | European Pat. Off. . | |
| 2549624 | 1/1985 | France . | |
| 8604173 | 7/1986 | Int'l Pat. Institute . | |
| 8605292 | 9/1986 | Int'l Pat. Institute . | |
| 0161202 | 12/1981 | Japan | 414/273 |
| 0127504 | 6/1986 | Japan | 414/277 |
| 1172840 | 8/1985 | U.S.S.R. | 414/331 |
| 0048605 | 5/1986 | World Int. Prop. O. | 221/88 |

*Primary Examiner*—Joseph J. Rolla
*Assistant Examiner*—Edward S. Ammeen
*Attorney, Agent, or Firm*—Caesar, Rivise, Bernstein, Cohen & Pokotilow

[57] ABSTRACT

A vending machine for articles, such as videotape cassettes, includes a rotatable turret having article-retaining compartments in which the articles to be dispensed are retained, and a vertically movable robotic arm located adjacent the turret for removing a desired article from the turret and directing the article to a discharge opening in the device. Preferably the vending machine is computer controlled to dispense the desired article from the machine, based upon an input signal provided by a user, and also to return an article to the machine, when the user desires to return it. A unique package arrangement for a videotape cassette includes a case having opposed planar walls and passageways extending through the surfaces in a central location thereof. A cassette to be retained in the case includes coded information on opposed surfaces thereof aligned with the passageways through the planar walls of the case to permit a scanner to read the coded information regardless of the orientation of the case as it is inserted into a discharge/access opening in a videotape vending machine.

12 Claims, 8 Drawing Sheets

10
14
12
16
18
3
4
9
20
21
26
36
40
42
44
46
60
62
63
64
66
68
70
132
136
140
144
145
149
152
156
160
161
170
182
184
186
188
190
403
414
420
422
424
426
428
430
452
457
460
462
464
466
468
470
500

FIG. 4
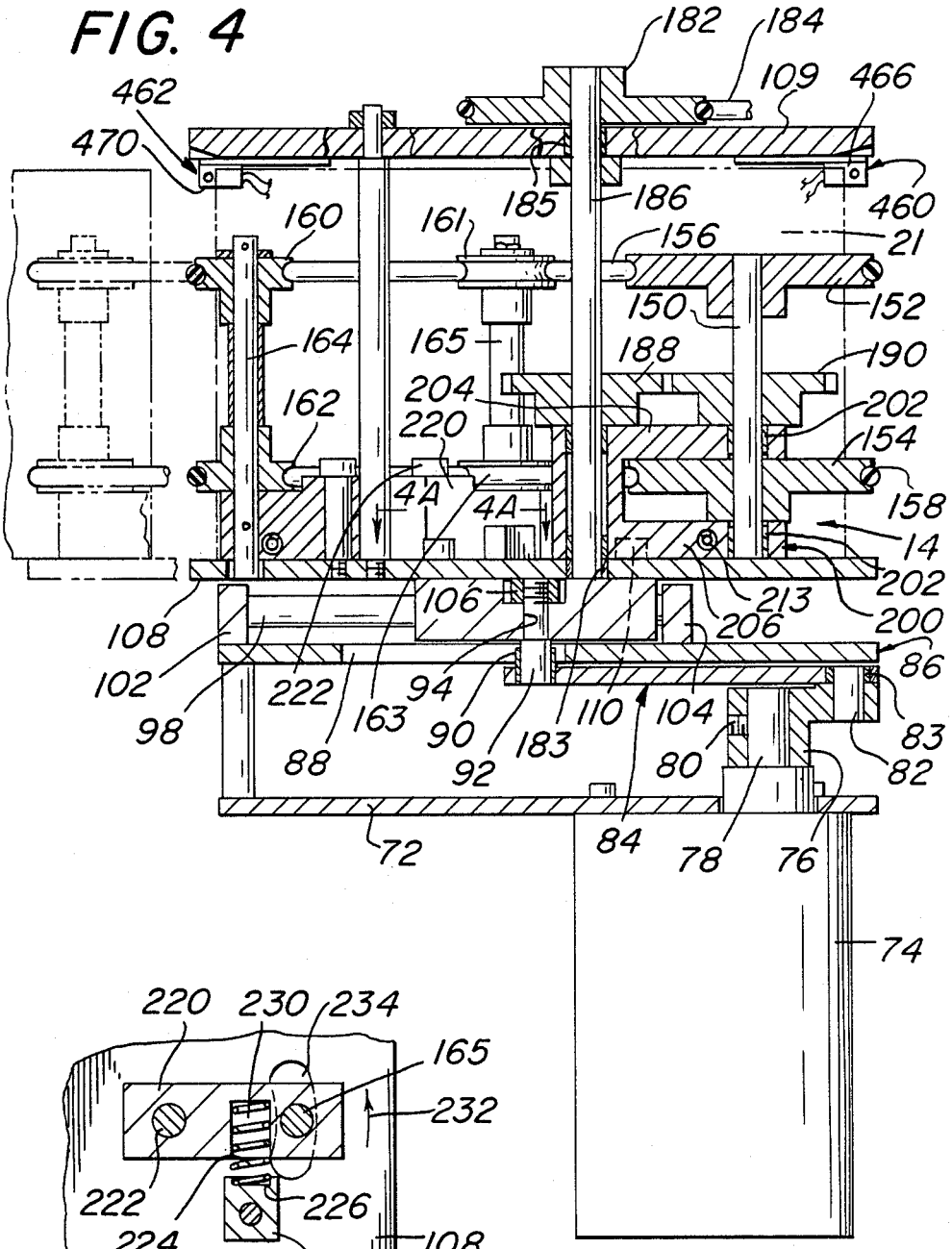
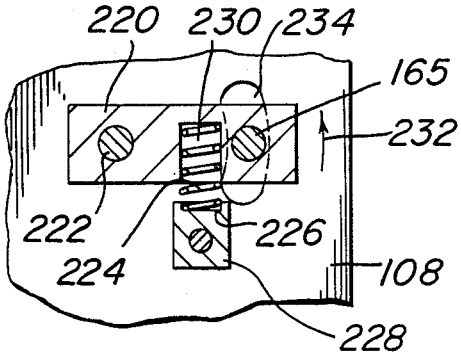
FIG. 4A

ARTICLE VENDING MACHINE EMPLOYING UNIQUE ROBOTIC ARM AND THE ROBOTIC ARMS EMPLOYED THEREIN

FIELD OF THE INVENTION

This invention relates generally to a vending machine and more specifically to a computer controlled vending machine for dispensing articles, such as videotape cassettes.

BACKGROUND ART

The business of renting and selling videotape cassettes has continuously increased over the last several years, and continues to increase. This increase in business has spurred new marketing and distribution channels, other than through conventional specialty rental stores. For example, videotape cassettes are now rented and sold in grocery stores, drug stores, and most recently through specially designed vending machines.

It is extremely important that videotape vending machines be capable of operating reliably, and without damaging the cassettes. Moreover, it is important that the cost of the machines, including maintenance costs, be maintained at a reasonable level to justify widespread use of such machines.

One type of prior art videotape vending machine stores the video tape cassettes in stationary bins arranged in array of vertically aligned, horizontal rows. A robotic arm is employed to move both vertically and horizontally to permit it to be aligned with the video tape cassettes to be rented and/or purchased. It is believed that the mechanical design of this type of system, and in particular, the mechanical design of the robotic arm, is more complex than is desirable.

Another system for dispensing videotape cassettes employs a gate associated with each bin in which a videotape cassette is stored. Selection of a desired cassette by inputting identifying information regarding the location of the cassette, actuates the gate of the bin in which the cassette is located, to permit the cassette to fall from the bin into an access area of the machine, where it can be retrieved by the renter. Cassettes dispensed in this type of machine are susceptable to being damaged or broken, as a result of permitting the cassettes to fall in an uncontrolled manner into the dispensing area from the retaining bins.

It is Applicant's belief that a need exists for an improved videotape cassette vending machine which is reliable in operation, and which is designed to prevent damage to the videotape cassette as it is being either dispensed from the machine or returned to the machine.

SUMMARY OF THE INVENTION

In accordance with this invention a vending machine for dispensing articles includes a rotatable turret in which the articles to be dispensed are stored and a vertically movable robotic arm for use in transporting an article from a desired location in the turret to a discharge opening of the machine. Drive means are provided to rotate the turret and vertically move the robotic arm, and control means are provided for the drive means to properly position the turret and robotic arm relative to each other to permit the desired videotape to be dispensed from the turret.

In a preferred embodiment of the invention the control means includes sensing means for sensing the rotational position of the turret and the vertical position of the robotic arm, and providing control signals representative of said rotational and vertical positions. The control means is responsive to the latter signals and an input signal from the user for positioning the turret and robotic arm in a desired predetermined location relative to each other for dispensing a desired article. In the most preferred embodiment of the invention the vending machine is for videotape cassettes, and the control means includes a computer.

In the preferred form of the invention the robotic arm is vertically movable by being mounted on a vertically movable elevator assembly, and the robotic arm is linearly movable relative to the elevator assembly toward and away from the turret for engaging and removing from the turret an article to be dispensed. In the most preferred embodiment the robotic arm includes a platform which is movable linearly relative to the elevator assembly, and article gripping means movable with the platform for gripping an article to be dispensed. A robotic arm drive means is provided for linearly moving the platform of the robotic arm, and also for moving the gripping means relative to the platform to thereby move the gripped article relative to the platform.

In the preferred form of this invention the robotic arm is designed to also receive an article to be returned to the vending machine, and to transmit the article to a desired location in the turret, at which it reinserts the article into the turret. Thus, in the preferred embodiment of the invention the vending machine is capable of both dispensing and receiving articles.

A unique case for a videotape cassette includes opposed walls, at least one of which has an opening provided centrally therein to be aligned with a code secured to a videotape cassette to be retained in the case. In the most preferred form of the invention an opening is provided centrally in opposed top and bottom walls of the case to cooperate with codes provided on opposite surfaces of the cassette to be retained in the case.

A unique videotape cassette of this invention includes coded information located substantially centrally on at least one surface thereof, and preferably on each of two opposed surfaces. Most preferably the coded information on each of the opposed surfaces is the same.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein:.

FIG. 4 is a sectional view taken along line 4—4 of FIG. 2;

FIG. 4A is a sectional view taken along line 4A—4A of FIG. 4;

DESCRIPTION OF THE PREFERRED EMBODIMENT OF THE INVENTION

Figure 1:
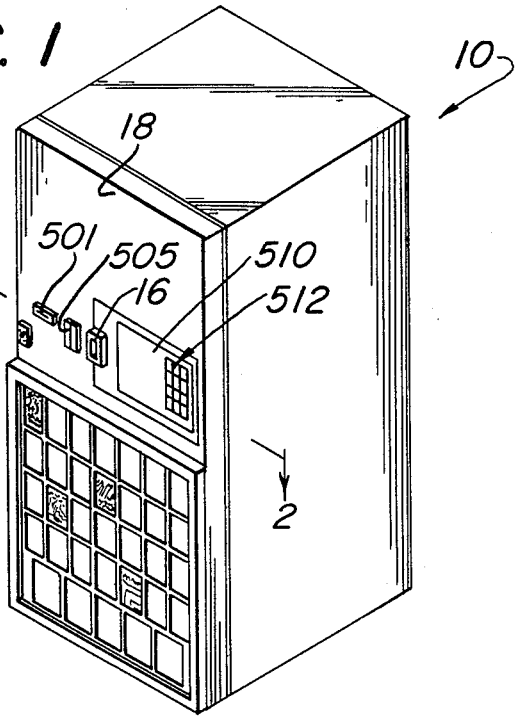
FIG. 1 is an isometric view of a vending machine in accordance with this invention.

Referring now in greater detail to the various figures of the drawings wherein like reference characters refer to like parts, a vending machine embodying the invention is generally shown at 10 in FIG. 1. As can be seen best in FIGS. 2 and 3 the vending machine 10 generally includes a rotatably mounted turret 12 in which articles to be dispensed are stored, and a vertically movable robotic arm 14 for use in transporting a desired article from the turret to a discharge/access passageway 16 extending through an outer wall 18 of the device.

In the preferred embodiment of the invention the vending machine 10 is employed to store and vend videotape cassettes 21, and accordingly the turret 12 is provided with a plurality of compartments 20 designed to receive and store such cassettes.

Figure 2:
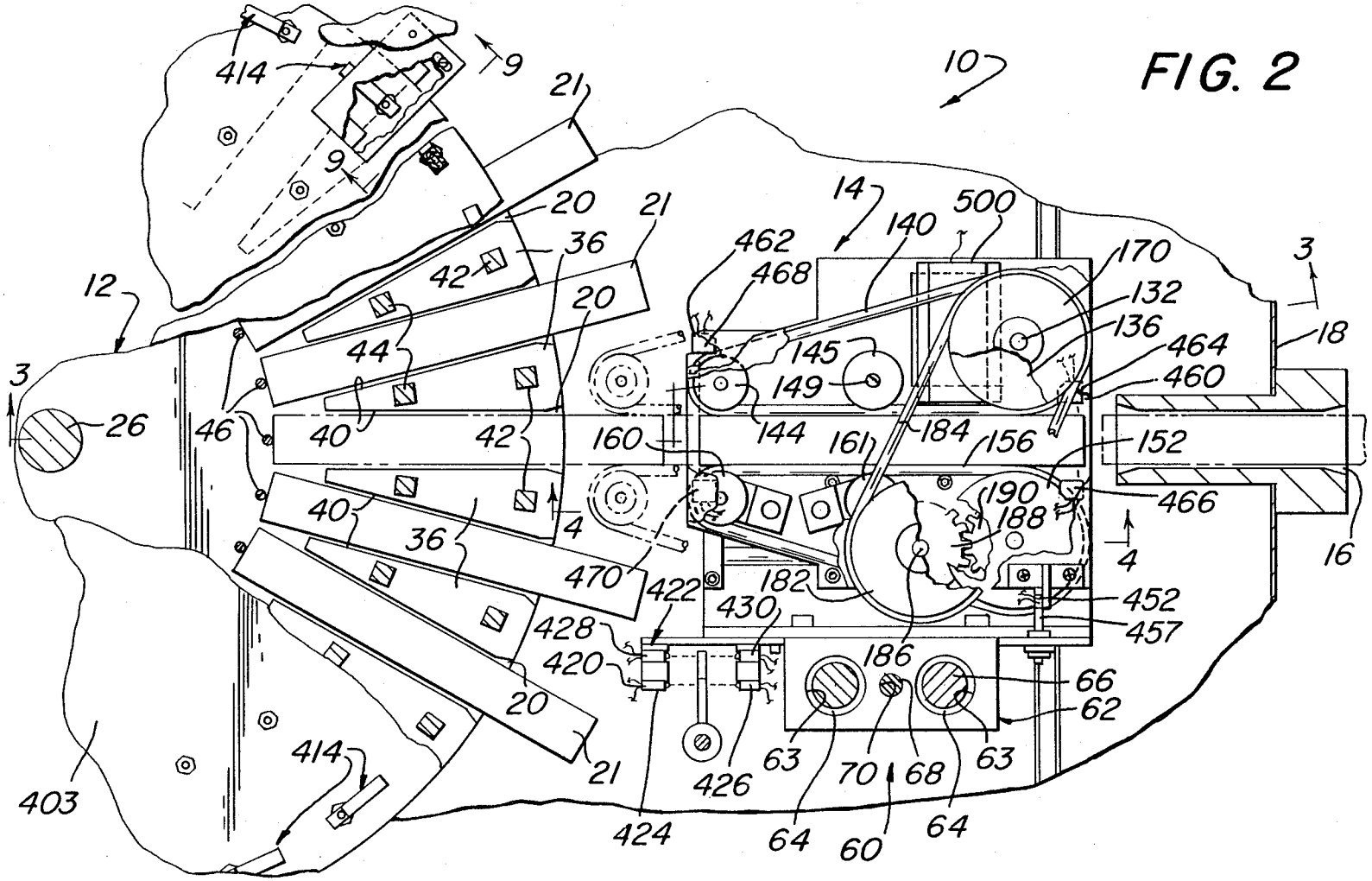
FIG. 2 is a fragmentary sectional view taken along line 2—2 of FIG. 1.
Figure 3:
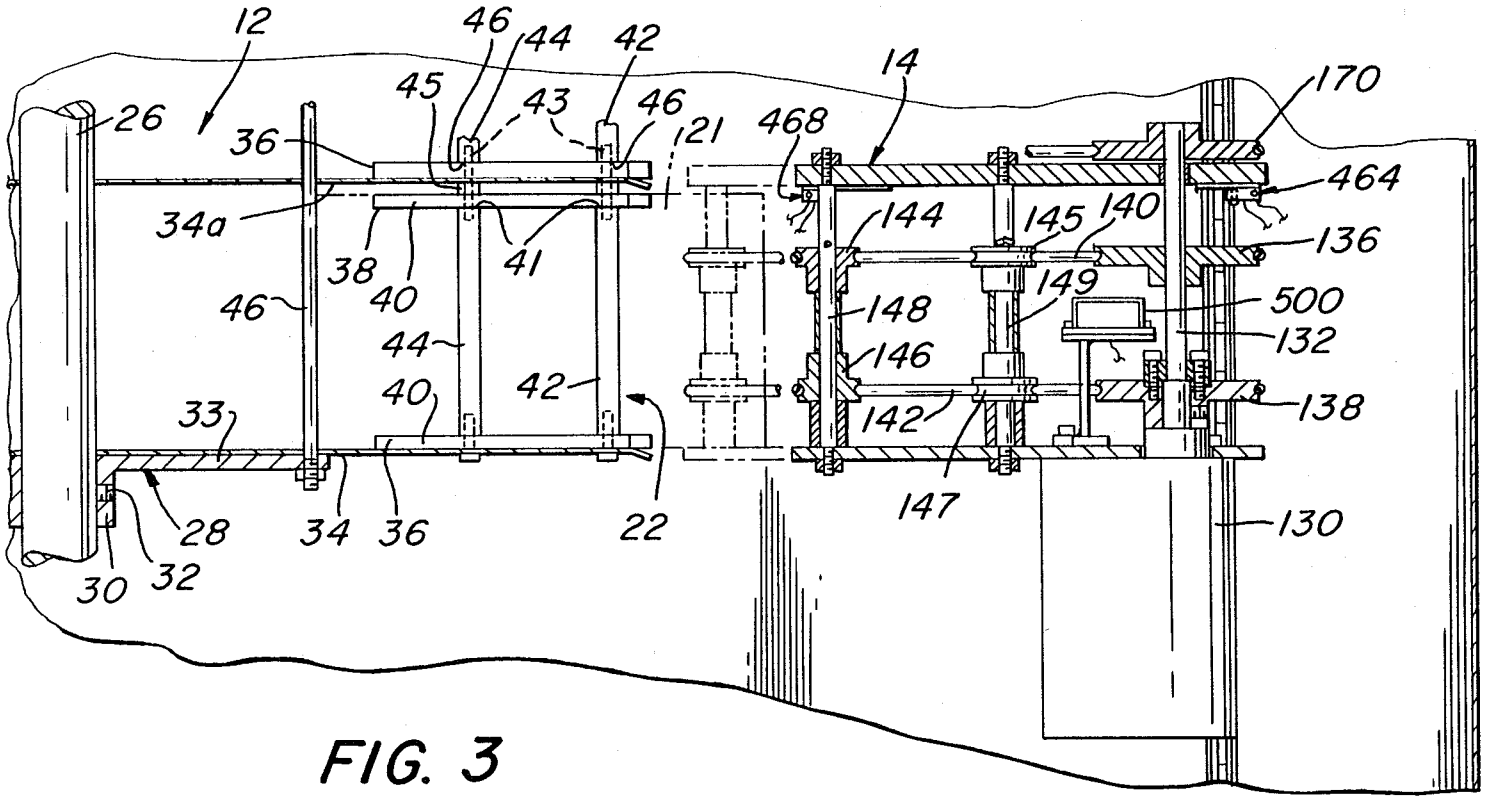
FIG. 3 is a sectional view taken along line 3—3 of FIG. 2.
Figure 6:
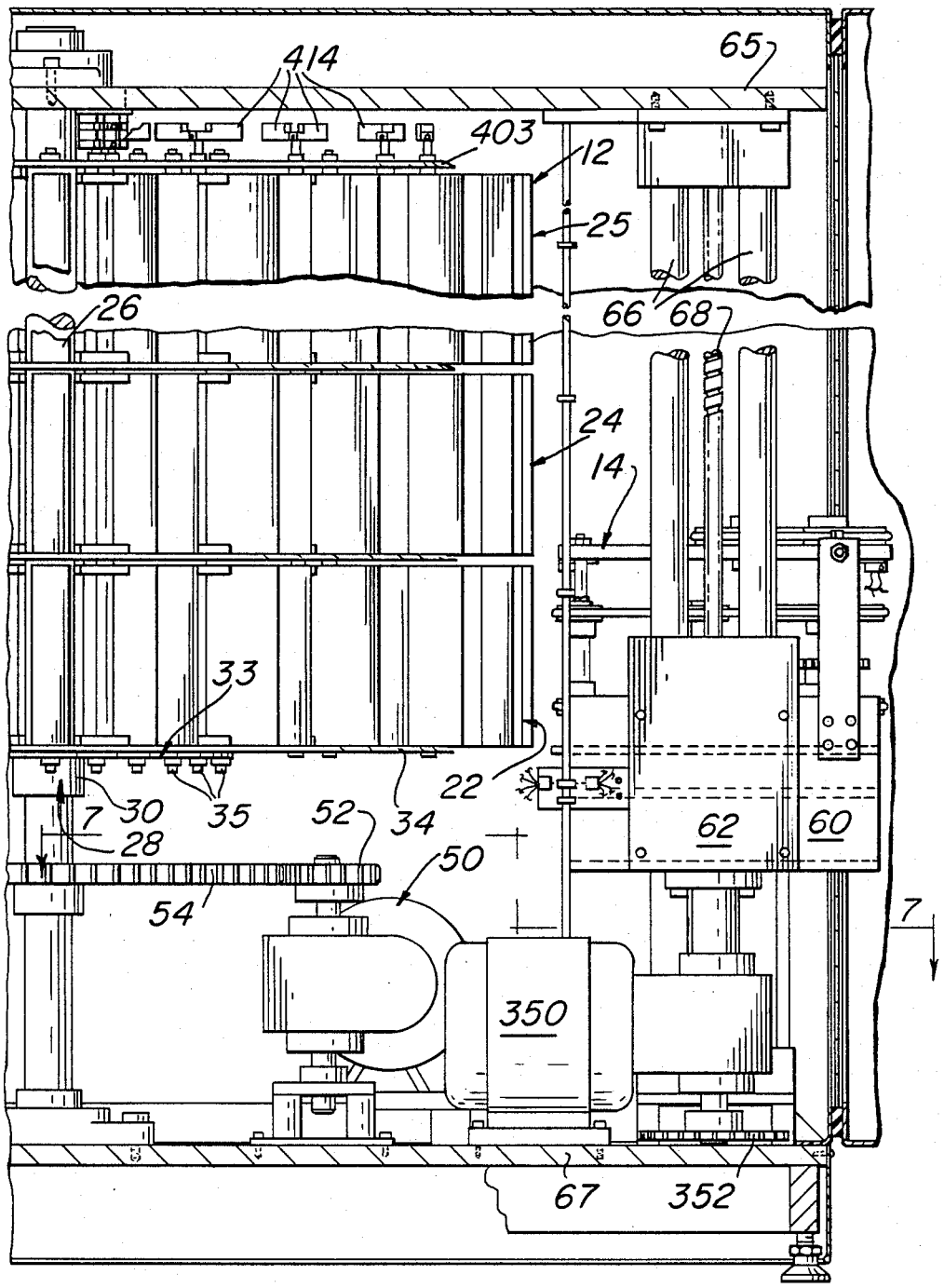
FIG. 6 is a side elevational view of the vending machine shown in FIG. 1, with the side panel removed to show details of construction.

Referring to FIGS. 2, 3 and 6, the rotatable turret 12 includes a plurality of passageways or compartments 20 therein, in which videotape cassettes 21 are retained for dispensing. These compartments are located in vertically-aligned tiers, three of which are indicated at 22, 24 and 25 in FIG. 6, with the compartments in each tier being disposed circumferentially about the turret and being assessable from the periphery of said turret. It should be understood that the number of aligned tiers employed in the turret is not a limitation on the present invention. However, in the preferred embodiment the turret is provided with eleven such tiers of compartments.

Still referring to FIGS. 2, 3 and 6, it can be seen that the turret 12 include a rotatably mounted shaft 26. A cylindrical collar 28 has a central hub 30 secured to the shaft 26 by a fastening screw or bolt 32, or similar fastening device. The collar 28 includes a horizontally disposed, planar flange 33 to which circular bottom wall 34 of the turret 12 is secured by a plurality of bolts 35 (FIG. 6). This bottom wall is the supporting surface of the lowermost tier 22 of compartments 20.

As can be seen in FIGS. 2 and 3, a plurality of sets (only one being shown in FIG. 3) of vertically spaced-apart, radially disposed plastic members 36, 38 are circumferentially spaced-apart from each other to divide each tier into the plurality of circumferentially spaced-apart compartments 20. The side surfaces 40 of the members 36 and 38 providing sidewalls of the compartments 20 for engaging or supporting side surfaces of the videotape cassettes 21 that are to be retained in the compartments.

As can be seen best in FIGS. 2 and 3, a plurality of sets of radially spaced-apart vertical support members 42 and 44 are circumferentially spaced-apart about the periphery of the turret to interconnect the vertically spaced-apart members 36 and 38. It also should be noted that a plurality of vertical, rod-like abutments 46 are fastened to the planar flange 33 of the collar 28, and extend vertically through the various tiers (e.g., 22, 24 and 25) at the rear end of each of the compartments 20 for engaging the cassettes 21, to thereby maintain the cassettes in proper position for reliable removal from the turret 12 by the robotic arm 14, in a manner to be described hereinafter.

As can be seen best in FIG. 3, each of the radially extending members 38, only one of which is illustrated, is maintained adjacent the top of each tier by resting on upper surfaces 41 of a corresponding set of radially spaced-apart, vertical support members 42 and 44. A pair of threaded studs 43 are secured in threaded passageways that are tapped downwardly through the upper surfaces 41 of the support members 42 and 44. Spacer members 45 are positioned on the upper surface of each radially extending member 38, and include passageways therein to receive corresponding threaded studs 43. The bottom wall **34*a* of the next adjacent tier (e.g., tier 24) is supported on the upper surface of the spacer members, and the radially disposed members 36 in the tier 24, only one of which is illustrated in FIG. 3, are disposed in circumferentially spaced-apart relationship to each other on the upper surface of the bottom wall 34*a*. The bottom wall 34*a* and radially disposed members 36 supported thereon have aligned openings in them (not shown) which, in turn, are aligned with the threaded studs 43 extending upwardly from upper surfaces 41 of the spaced-apart support members 42 and 44 in tier 22. As a result of this arrangement each of the threaded studs 43 is received within aligned openings in a corresponding spacer member 45, bottom wall 34*a* and aligned, radially disposed member 36. The support members 42 and 44 of the tier 24 are provided with threaded passageways 46 extending upwardly through lower surfaces thereof, to thereby threadedly receive the threaded studs 43. As a result of the above described construction the various tiers of compartments in the turret 12** are firmly and reliably attached together.

Figure 7:
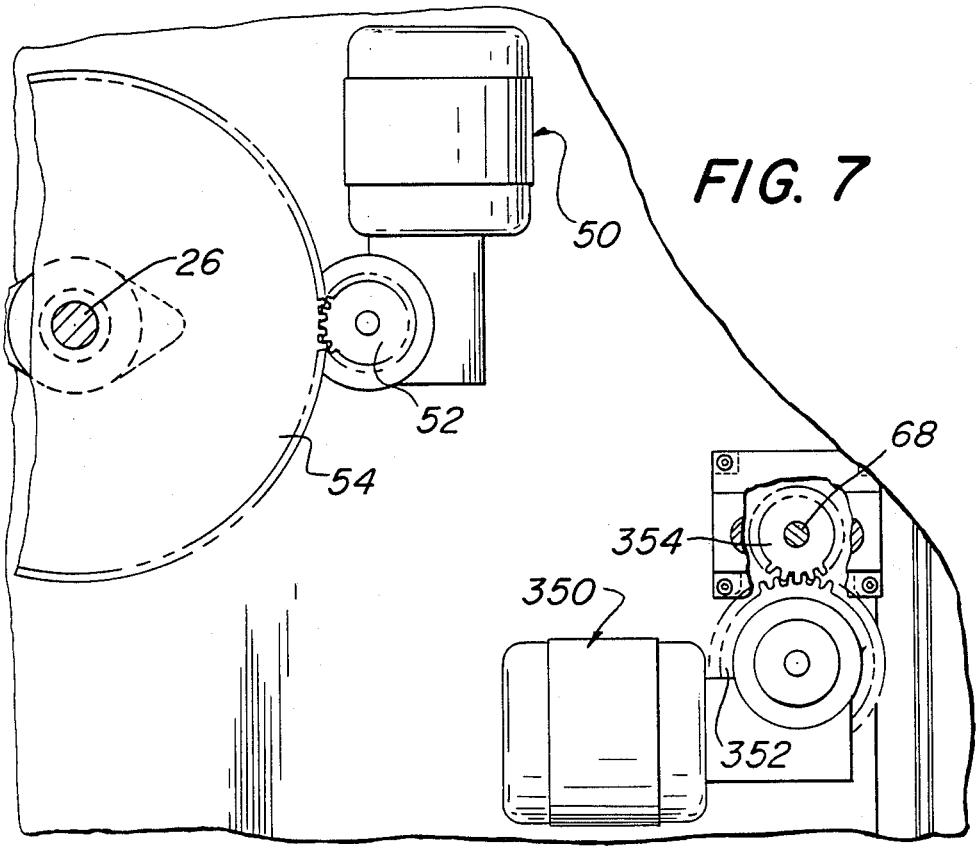
FIG. 7 is a sectional view taken along line 7—7 of FIG. 6.

Referring to FIGS. 6 and 7, the drive means for rotating the turret includes a high current reversible drive motor 50 driving a drive gear 52 which, in turn, cooperates with driven gear 54 connected to the rotatable shaft 26 of the turret. Thus, when the high current motor 50 is actuated it will rotate the turret 12 through the shaft 26 by the cooperation of the gears 52 and 54.

Referring to FIGS. 2, 4, 5 and 6 the robotic arm 14 is mounted for movement on an elevator assembly 60 for either removing or inserting a videotape cassette 21 into a desired compartment 20 of the turret 12, in a manner which will be described in detail hereinafter.

The elevator assembly 60 includes a guide block 62 provided with a pair of vertical passages 63 including bushings 64 therein for receiving a pair of guide rods 66. As can be seen best in FIG. 6, the guide rods 66 are bolted through suitable connectors to upper and lower walls 65, 67 of the machine. A ball screw drive rod 68 is rotatably mounted within a threaded passage 70 of the guide block 62 to effect vertical movement of the elevator assembly 60 when the drive rod is rotated.

Figure 5:
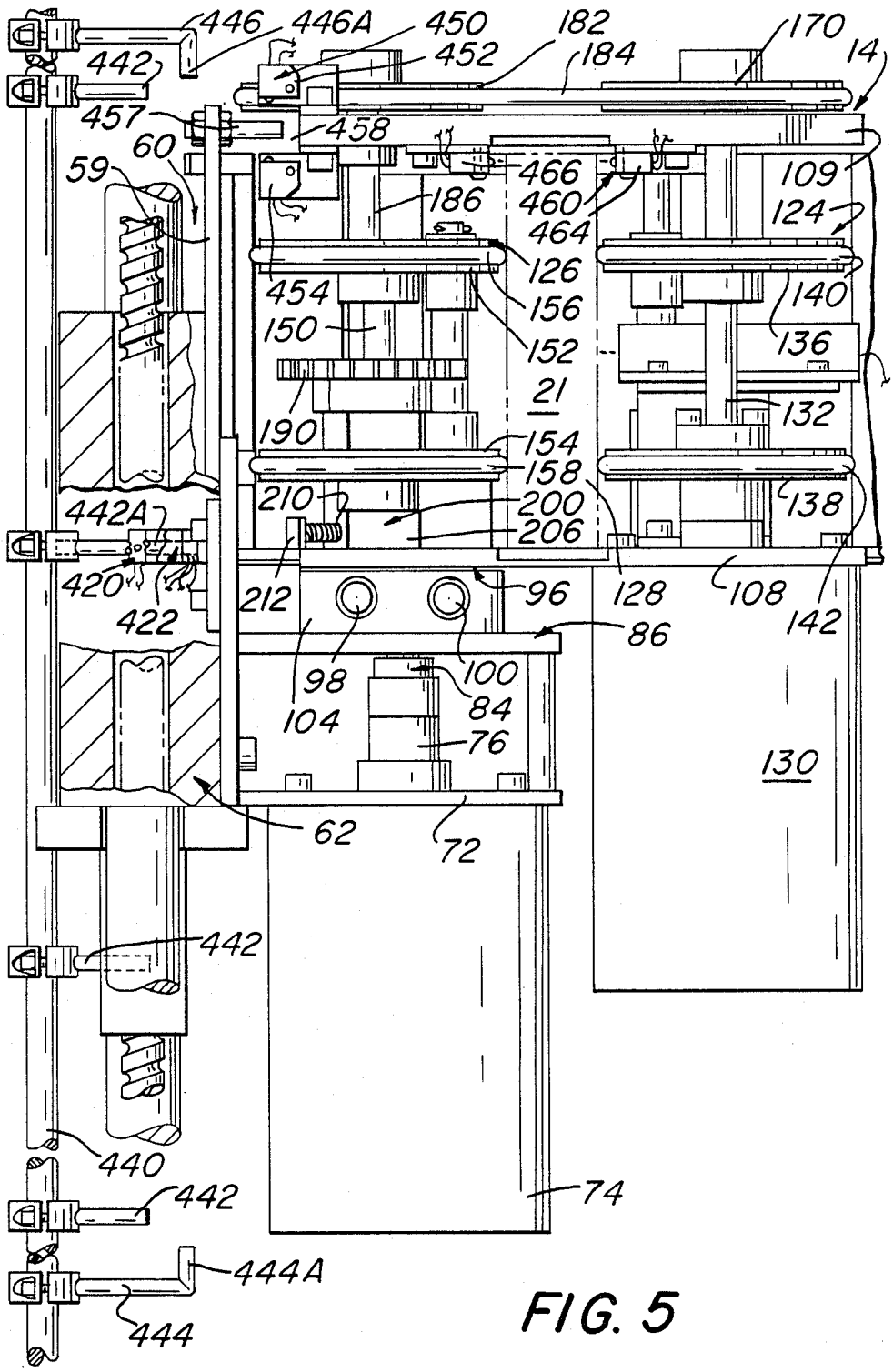
FIG. 5 is a front elevational view of the vending machine shown in FIG. 1, with the front panel removed to show details of construction.

Referring to FIGS. 4 and 5, a lower horizontal wall 72 of the elevator assembly 60 has a low current motor 74 bolted thereto. A crank 76 is secured to output shaft 78 of the motor 74 by a threaded fastener 80, or similar fastening device. A transverse arm of the crank 76, which is offset from the output shaft 78, has a pin 82 fixed thereto, and the pin is rotatably received within a bushing 83 at one end of crank arm 84.

Still referring to FIG. 4, a guide plate 86 has an elongate passage 88 therein, and a bushing 90 fixed to the end of the crank arm 84 opposite the end to which bushing 83 is attached extends upwardly into the passage 88. A connecting pin 92 is rotatably received within the bushing 90, and has a threaded section extending through the elongate passage 88 in the guide plate 86, and through a passageway 94 in a support block 96. A threaded nut 106 engages the threaded section of connecting pin 92 to lock the supporting block 96 to the pin. The support block 96 is mounted for reciprocating movement on transversely extending, spaced-apart guide rods 98 and 100 (FIGS. 4 and 5) which, in turn, are secured to transversely spaced apart, vertical abutments 102, 104 that are welded or otherwise secured to the upper surface of the guide plate 86. The supporting block 96 is secured to the platform 108 by a plurality of bolts 110, two of which are shown in FIG. 4, whereby reciprocating motion of the block 96 along the guide rods 98 and 100 will likewise reciprocate the robotic arm 14.

The crank 76 and crank arm 84 attached thereto are dimensioned so that the reciprocating stroke of the robotic arm 14 will be two (2) inches, with the closest position of the robotic arm 14 to the turret 12 being shown in phantom representation in FIGS. 3 and 4. This is the amount of movement needed to permit the robotic arm either to engage and remove a videotape cassette retained within a compartment 20 of the turret 12, or to reposition a cassette from the robotic arm into the appropriate compartment of the turret.

Referring to FIGS. 2, 4 and 5, the robotic arm 14 includes the aforementioned cassette-supporting platform 108, which is movable linearly through actuation of the low current motor 74. Other components of the robotic arm are carried on the platform 108 to move therewith. As will be explained in detail hereinafter, two sets of cassette belt drives 124 and 126 (FIG. 5) are secured to the platform 108 and employ belts movable relative to the platform 108, to thereby control the movement of a cassette 21 relative to said platform.

As can be seen best in FIG. 5, the two sets of cassette belt drives 124 and 126 are spaced-apart from each other on opposite sides of a cassette-receiving area 128 of the robotic arm, the cassette being shown in phantom at 21.

Referring to FIGS. 3 and 5, a low current motor 130 bolted to the cassette-supporting platform 108 has an output shaft (not shown) directly connected to rotatable shaft 132 on which vertically spaced-apart pulleys 136 and 138 are positively secured. As can be seen in FIG. 3, a pair of belts 140 and 142 are trained about the periphery of the vertically spaced-apart pulleys 136 and 138 and cooperating idler pulleys 144 and 146, respectively. The idler pulleys 144 and 146 are mounted on vertical shaft 148. A pair of vertically spaced-apart belt support pulleys 145, 147 are retained on vertical shaft 149 and support the cassette-engaging run of the belts 140 and 142 intermediate the driven pulleys 136, 138 and idler pulleys 144, 146.

As can be seen best in FIGS. 4 and 5, the other cassette belt drive 126 includes a rotatable shaft 150 which is driven in a manner to be explained hereinafter. Vertically spaced-apart pulleys 152 and 154 are firmly secured to the shaft 150 to be driven therewith, and a pair of continuous belts 156 and 158 are trained about the pulleys 152 and 154 and cooperating, spring-loaded idler pulleys 160 and 162. These idler pulleys are rotatable about idler pulley shaft 164. A pair of vertically spaced-apart belt support pulleys 161, 163 are mounted on vertical shaft 165 and also are spring loaded to support and tension the cassette-engaging run of the belts 156, 158 intermediate the driven pulleys 152, 154 and the idler pulleys 160, 162.

Referring to FIGS. 2, 4 and 5, the manner in which the pulleys 152 and 154 are rotatably driven will now be described. The rotatable shaft 132 which is positively driven by low current motor 130 is connected at its upper end to a pulley 170, for rotating said pulley along with the vertically spaced-apart pulleys 136 and 138. A second pulley 182 is rotated by the pulley 170 through an interconnecting, continuous belt 184. The second pulley 182 is secured to a vertical pulley shaft 186 that is rotatably mounted in bushings 183 and 185 secured in the cassette-supporting platform 108 and upper supporting plate 109, respectively. The shaft 186 carries a drive gear 188 which is rotated with said shaft, and cooperates with a driven gear 190 secured to the rotatable shaft 150 on which the vertically spaced-apart pulleys 152, 154 are secured. Rotation of the driven gear 190 by the drive gear 188 rotates the shaft 150 in an opposite rotational direction to the shaft 132, so that the continuous belts 140, 142, 156 and 158 will engage sidewalls of the cassette 21 while moving in the same direction. This arrangement permits the belts to feed a cassette relative to the supporting platform 108, either for the purpose of withdrawing a cassette from a compartment 20 within the turret 12, or for replacing a cassette from the robotic arm 14 into a compartment of the turret.

Referring to FIGS. 4 and 4A, in order to provide positive frictional engagement of the cassette 20 by the continuous drive belts 140, 142, 156 and 158, the pulleys 152–154, 160–162 and intermediate belt support pulleys 161–163 are spring loaded toward opposed pulleys 136–138, 144–146 and belt support pulleys 145–147.

Referring specifically to FIGS. 4 and 5, a U-shaped yoke 200 is rotatably mounted about the rotatable shaft 186 that mounts pulley 182 thereon. The shaft 150 is rotatably journaled in bushings 202 provided in vertically spaced-apart arms 204, 206 of the yoke 200. A compression spring 210 (FIG. 5) is mounted in compression between a fixed block 212 and within a recess 213 in the lower arm 206 of the yoke 200, to thereby bias the yoke, as well as the pulleys 152 and 154 connected to the shaft 150, in a direction toward the pulleys 136, 138 carried on the rotatable shaft 132.

The vertical shaft 164 rotatably supporting the idler pulleys 160, 162, and the vertical shaft 165 rotatably supporting the belt supporting pulleys 161, 163 are each spring biased in the same manner in a direction toward the shaft 148 supporting the idler pulleys 144, 146, and the shaft 149 supporting the belt supporting pulleys 145, 147, respectively. Accordingly, the manner of biasing the support shaft 165 will be described in connection with FIG. 4A, it being understood that the vertical shaft 164 supporting the idler pulleys 160, 162 are biased in exactly the same manner.

Referring to FIG. 4A, a block 220 is mounted for pivotable movement about a shoulder bolt 222, which fastens the block to the platform 108 of the robotic arm 14. A compression spring 224 is mounted in a recess 226 in a fixed block 228, and also in a recess 230 within the rotatable block 220. In this manner, the block 220, as well as the support shaft 165 secured thereto and the tensioning pulleys 161, 163 attached to the shaft 165, are spring loaded to move in the direction indicated by arrow 232. Arcuate movement of the shaft 165 is permitted as a result of the shaft extending into an arcuate recess 234 in the platform 108. As stated above, the same arrangement for spring biasing the shaft 165 is employed to spring bias the shaft 164 supporting the idler pulleys 160, 162.

Referring to FIGS. 6 and 7, a high current motor 350 is shown for effecting vertical movement of the elevator assembly 60 and the robotic arm 14 carried thereby. Specifically, the motor 350 is bolted to the lower wall 67 of the machine, and drives a gear 352 which meshes with driven gear 354. This latter gear is connected to the ball rod 68 to rotationally drive the ball rod for effecting vertical movement of the elevator assembly 60 through cooperation of the spiral threads on the ball rod with cooperating threads in the passageway 70 extending through the guide block 62 of the elevator assembly 60. As will be explained hereinafter, operation of the motor 350 is carried out under the control of a computer 508 (FIG. 11) to effect the desired vertical movement of the robotic arm 14.

As will now be explained, a number of optical proximity sensors are employed to aid in either determining or monitoring the location of various elements of the vending machine 10, to thereby assist in the computer controlled operation of said machine.

Referring to FIGS. 2, 6 and 8 through 10, the rotatable turret 12 is provided with a proximity sensing system for determining the rotational location of the turret relative to a fixed, reference location (i.e., the "home" position). As can be seen best in FIG. 8, a pair of proximity sensors 400, 402 are connected to an upper wall 65 of the machine and extend downwardly therefrom. These sensors terminate above an upper wall 403 of the turret 12 for cooperating with a plurality of position-locating flags 414, each flag being secured to the upper wall 403 of the turret in a region aligned with a vertically aligned set of compartments 20, said sets being disposed circumferentially about the turret 12. In the illustrated embodiment there are 24 vertical sets of compartments; however, the specific number of sets in not a limitation on the present invention.

The upper proximity sensor 400 includes a light emitter 404 and a receiver 406 therefor. The lower proximity sensor 402 includes a light emitter 408 and an aligned receiver 410.

Figure 8:
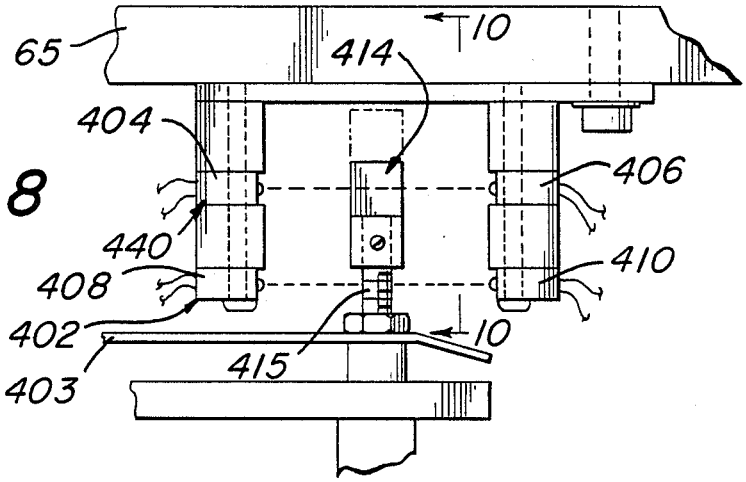
FIGS. 8–10 show the cooperative relationship between optical proximity sensors and flags or indicators on the turret for sensing the rotational position of the turret relative to a "home" position.
Figure 9:
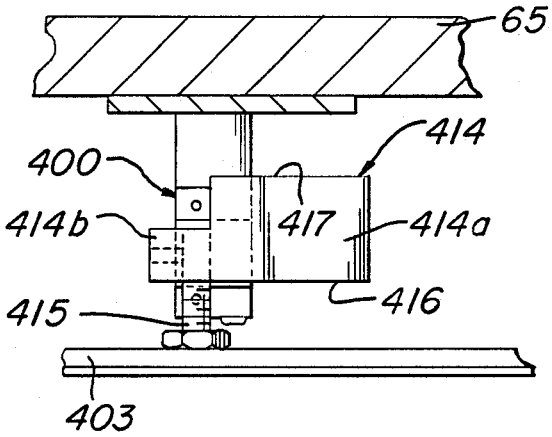

Referring specifically to FIGS. 8 and 9, it can be seen that each of the flags 414 has an upper, stepped surface 417 cooperating with a lower, linear surface 416 to provide a flag section **414*a* having a greater height than an adjoining flag section 414*b*. Each of the flags is mounted on a vertical post 415 so as to position the lower surface 416 of each flag above the lower proximity sensor 402. That is, the flags 414 are positioned so that they never intercept the light emitted from emitter 408 of the lower proximity sensor, and accordingly, only the supporting vertical posts for the flags will interrupt the light from emitter 408**.

The vertical pin 415 supporting each flag does intercept the lower proximity sensor 402 to thereby permit the sensor to "count" the rotational position of the turret relative to a fixed reference location, or "home" position.

Figure 10:
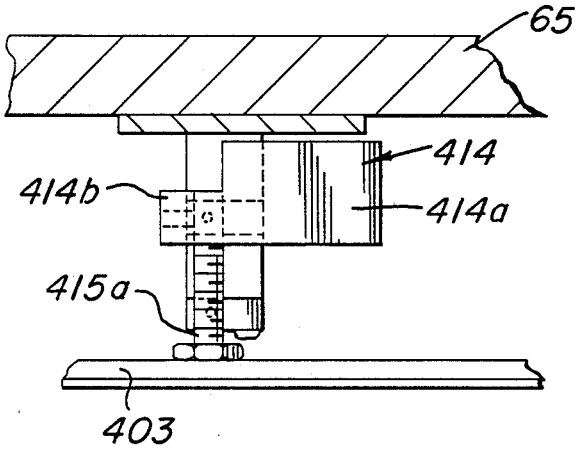

As can be seen best in FIG. 10, and in phantom in FIG. 8, the home position is established by mounting one of the flags 414 on a vertical pin 415A which is higher than the remaining pins 415. This positions the reduced-height section **414*b* of the attached flag 414 in a location to intercept the upper proximity sensor 400, at the same time that the lower proximity sensor 402 is interrupted by the pin 415A. The flag 414 at the home position is the only one located to permit the reduced-height section 414*b* to intercept the upper proximity sensor 400. Thus, it is only at this reference location that both proximity sensors 400, 402** will be interrupted, to thereby provide a distinctive signal representative of the home position.

In all locations on the turret, other than the home position, when the flag section **414*a* is in position to intercept the upper proximity sensor 400, the lower proximity sensor 402 will not be interrupted, and when the post 415 interrupts the lower proximity sensor 402, the flag section 414*b* aligned with the post will not interrupt the upper proximity sensor 400**.

The above-described arrangement of sensors 400 and 402, and locating flags 414 and posts 415 permits the sensing of the location of he turret in a precise manner, so that compensating adjustments can be made by rotating the turret in either direction, in the event that the desired compartment 20 from which a cassette 21 is to be removed, or into which a cassette it is to be replaced, initially is located either slightly too far to the left, or slightly too far to the right of the robotic arm 14. Specifically, if the compartment 20 is slightly to the left of its required location relative to the robotic arm 14, then only the upper sensor 400 will be interrupted by flag section **414*a*. The pins 415 will not block the lower proximity sensor 402 due to the slight misalignment. When only the upper sensor 400 is interrupted the electrical signal which is directed to the control device, e.g., a computer, will identify that the misalignment is to the left, thereby resulting in a compensating adjustment being made by actuation of the turret drive motor 50**.

If the compartment 20 initially has been aligned slightly to the right of its required location relative to the robotic arm 14, neither of the sensors 400, 402 will be interrupted by the flag or supporting post. The signal generated in this case will be directed to the control device to identify that the compartment is slightly to the right of its desired location, thereby resulting in actuation of the motor 50 to make the required compensating adjustment in the turret location.

Thus, it can be seen that the sensed location of the turret 12, resulting from the cooperation of optical proximity sensors 400, 402 with the flags 414 and vertical supporting pins 415, generates electrical signals which are directed to the control device, e.g., a computer, for the purpose of assisting in controlling the operation of the vending machine 10. In particular the sensors and cooperating flags and pins generate electrical signals which identify the rotational position of the turret relative to the home position. When the desired location is reached, as is identified by an input signal to the computer from the user of the machine 10, the computer will stop the operation of turret drive motor 50, to thereby properly position the desired compartment 20 of the turret 12 adjacent the robotic arm 14. Adjustments for any slight misalignment of the compartment with the robotic arm are detected by the sensor system, as described above, to permit compensating rotational adjustments to be made by the motor 50. It should be noted that the computer program is designed to actuate the motor 50 to rotate the turret 12 in either direction, with the specific direction of rotation being selected to provide the shortest path of travel to bring a desired compartment 20 of the turret into alignment with the robotic arm 14.

A sensing system similar to that employed for the turret 12 is employed to sense the vertical location of the elevator assembly 60, and the robotic arm 14 attached thereto, relative to a fixed reference location, or home position. This sensing system provides a signal to the computer to assist in establishing the desired vertical position of the robotic arm 14 relative to the turret 12.

Referring to FIG. 2, the sensing system for the elevator assembly 60 and robotic arm 14 attached thereto includes a pair of transversely spaced-apart optical proximity sensors 420 and 422 secured to the elevator assembly 60 for movement therewith. The proximity sensor 420 includes an emitter 424 and an aligned receiver 426. The proximity sensor 422, which is located closer to the elevator assembly 60 than the proximity sensor 420, includes an optical emitter 428 and an aligned optical receiver 430.

As can be seen best in FIG. 5, a vertical supporting rod 440 is positioned adjacent the elevator assembly 60 and has a plurality of vertically spaced-apart, transversely extending, position locating pins 442 extending laterally therefrom. All of the pins 442 are of the same transverse dimension, except for pin 442A, which extends beyond the remaining pins 442.

The lowermost position locating pin 444 extends transversely from the rod 440 for substantially the same distance as the transversely extending rod 442A, and terminates in a vertically extending segment 444A.

The uppermost position locating pin 446 extends transversely from the vertical rod 440 substantially the same distance as the lowermost pin 444, and then terminates in a downwardly extending vertical section 446A.

The upwardly extending vertical section 444A of the lowermost locating pin 444 and the downwardly extending vertical section 446A of the uppermost locating pin 446 are positioned to intercept only the proximity sensor 422 closest to the elevator assembly 60. In the extreme upper and lower positions of the elevator, the light emitted from the emitter 424 of the proximity sensor 420 is received by its cooperating receiver 426.

In all intermediate positions of the elevator assembly, other than at the location of transverse pin 442A, the pins 442 will intercept only the proximity sensor 420, and thereby block only the light emitted from the emitter 424.

When the proximity sensors 420 and 422 are intercepted by the transversely extending locating pin 442A, both of the proximity sensors 420 and 422 will be blocked by said pin, thereby generating a signal indicative of the "home position" of the elevator. It should be noted that the elevator locating pin 442A is positioned in a vertical location on the rod 440 such that its interception by the horizontally spaced-apart proximity sensors 420 and 422 will take place when the cassette-supporting platform 108 of the robotic arm 14 is aligned with the discharge/access passageway 16. Thus, when the elevator assembly 60 is in its home position, the robotic arm 14 is in proper position to receive a cassette 21 to be returned to the machine 10, and also to dispense a cassette which has been transferred to the robotic arm from a desired compartment 20 in the turret 12.

Referring to FIGS. 2 and 5, an optical proximity sensor 450 is provided for detecting linear movement of the robotic arm 14, relative to the elevator assembly 60. The proximity sensor 450 includes a light emitter 452 and an aligned receiver 454. The emitter and receiver are secured to opposed upper and lower surfaces of an upper supporting plate 109 of the robotic arm 14. The plate 109 is interrupted by a recess 458 to permit light from the emitter 452 to be detected by the receiver 454. A transversely extending pin 457 is secured to a vertical support 59 of the elevator assembly 60, and is positioned between the emitter 452 and receiver 454 of the sensor 450 when the robotic arm is in its "home" position, fully retracted from the turret 12. Thus, when the robotic arm 14 is in its home position the light emitted from the emitter 452 will not be detected by the receiver 454. However, when the robotic arm 14 is moved linearly relative to the elevator assembly 60, through actuation of low current motor 74, the sensor 450 will be moved relative to the transverse pin 457, thereby permitting the receiver 454 to sense the light from the emitter 452. When this occurs a signal is directed to the computer to advise the computer that the robotic arm 14 has moved linearly relative to the elevator assembly 60. As will be explained hereinafter, this signal is employed to aid in controlling the operation of the vending machine 10.

Referring to FIGS. 2 through 5, two optical proximity sensors 460 and 462 are secured to the upper wall of the robotic arm 14. One of the sensors 460 is located adjacent the driven pulleys 136, 138–152, 154 of the robotic arm, which pulleys are closest to the discharge/access passageway 16 when the robotic arm is in its home position, and the other optical proximity sensor 462 is located adjacent the idler pulleys 144, 146–160, 162 at the end of the robotic arm opposite the location of the first optical proximity sensor 460.

As can be seen best in FIGS. 2 and 5, the optical proximity sensor 460 includes an optical emitter 464 aligned with an optical receiver 466.

Referring to FIGS. 2 through 4, the optical proximity sensor 462 adjacent the idler rollers includes an optical emitter 468 (FIGS. 2 and 3) in transverse alignment with an optical receiver 470 (FIGS. 2 and 4).

As can be seen best in FIG. 4, the spacing between the optical proximity sensor 460 and the optical proximity sensor 462 is slightly greater than the length of the cassette 21 to be received therebetween, so that when the cassette 21 is centrally located between the sensors 460 and 462, and thereby properly positioned on the robotic arm 14, the light emitted by both of the emitters 464, 468 will be received by their corresponding receivers 466, 470 to assist in controlling the operation of the low current motor 130 responsible for driving the continuous drive belts 140, 142, 156 and 158 of the two sets of cassette belt drives 124, 126.

Referring to FIGS. 2 and 3, a bar code scanner 500 (e.g., Scanamatic S23) is mounted on the platform 108 of the robotic arm 14 for reading coded information on a cassette 21, such as the title of the cassette, represented by the first four digits of the code, and the particular version if there is more than one copy, represented by the second four digits of the code. The signal generated by the bar code scanner 500, after it has read the code, is fed into the computer for assisting in operating the machine 10, as will be explained in detail hereinafter.

It should be noted that a printer (not shown, but identified in FIG. 11 at 503), such as a Omni-Print, 20 Column Thermal printer, is connected to the computer, and is controlled thereby to provide a written receipt to the user through slot 501 provided in the front wall 18 of the machine (FIG. 1). The receipt is only issued after the coded information has been read by the scanner 500, upon the insertion of a returned cassette 21 through the discharge/access opening 16 of the machine, and the "read" information has been transmitted to the computer (not shown, but identified in FIG. 11 at 508).

Figure 12:
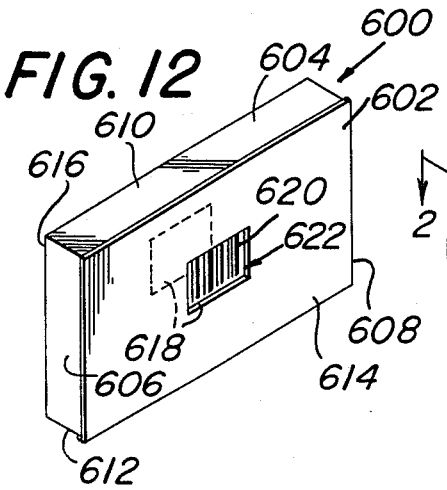
FIG. 12 shows a unique case for a videotape cassette, and a unique coded cassette therein.

Referring to FIG. 12 a unique arrangement is provided for storing videotape cassettes in a retaining case, to permit the case to be inserted into the discharge/access openings 16 in an orientation which will be received in said opening, while assuring that coded information on the cassette will be read by the bar code scanner 500. In particular, the packaged arrangement includes a videotape cassette case 600, which can be of any conventional, well-known design. In the illustrated embodiment the case 600 includes a base section 602 in which a videotape cassette is initially inserted, and a hinged cover 604 to be closed after the cassette has been inserted in the case. In the illustrated embodiment the case further includes opposed sidewalls 606, 608, opposed front and rear walls 610, 612, respectively, a planar bottom wall 614 and a planar top wall 616.

In accordance with a unique feature of this invention an opening, or window, 618 is provided centrally through the bottom wall 614 and top wall 616. It should be understood that these latter walls are the ones that are oriented in a vertical plane when the case 600 is inserted into the discharge/access opening 16. Also in accordance with a preferred feature of this invention the relevant coded information 620 to be read from cassette 622 by the scanner 500 is included on each of the opposed surfaces of said cassette to be retained within the case, in locations to align with each of the openings 618.

As a result of the above-described arrangement the coded information 620 to be read from the cassette 622 will always be aligned with the scanner 500, regardless of the orientation of the case 600, as it is inserted into the discharge/access opening 16. That is, regardless whether the front wall 610 or rear wall 612 is facing upwardly, a window 618 in one of the bottom or top walls 614, 616, will be aligned with the scanner 500. Also, regardless whether sidewall 606 or 608 is the leading edge directed into the opening 16, one of the windows 618 in a bottom wall 614 or top wall 616 will be aligned with the scanner. As a result of this arrangement a user of the vending machine does not need special instructions to position the case within the access opening 16 in any specific orientation.

The vending machine 10 further includes a mag-card reader 504, such as a Neuron 570-lR Mag-Card Reader, to read a user's credit card, and, if the information read from the card meets predetermined criteria, to commence operation of the machine 10 for permitting a user to rent a cassette 21 therefrom. The credit card is read by sliding it vertically through slot 505 in the front wall 18 of the machine (FIG. 1).

Figure 11:
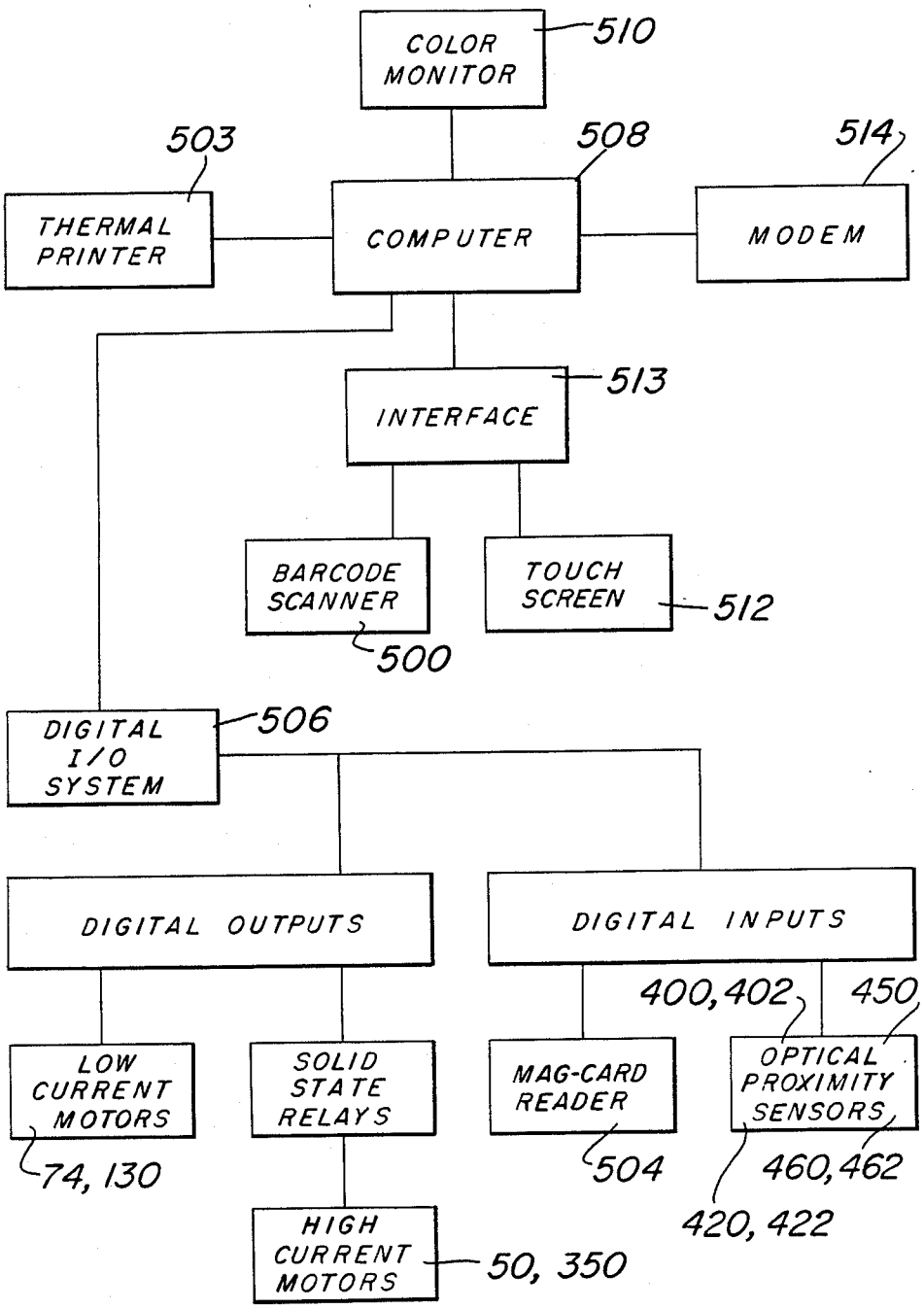
FIG. 11 is a block diagram showing the manner in which various elements of the machine cooperate with each other, and in particular, the manner in which the computer is interconnected to the various inputs it receives, and to the various devices it controls.

Referring to FIGS. 1 and 11, the general operation of the vending machine 10 will now be described.

To commence operation of the vending machine 10, a person desiring to rent a videotape cassette 21 passes his or her credit card through the mag-card reader 504, by sliding the card through slot 505 in the front wall of the machine. The reader 504 is interconnected through digital input/output system 506 to an internal computer 508. In the preferred embodiment of this invention the digital input/output system is an Opto 22 Pamux 4, and the computer is a Standard 286 computer, 10 Mhz AT compatible.

The computer 508 checks the credit card to determine whether it is valid (e.g., that it is of the required format), and also to determine how many outstanding rental cassettes are keyed to the card. If the person desiring to rent a cassette already has the maximum permitted number of rentals outstanding (e.g., three) then the computer prompts the person, through a display on a color monitor 510 (FIGS. 1 and 8), to return one or more of the outstanding cassettes before he or she will be permitted to take out an additional rental. In the preferred form of this invention the color monitor 510 is a NEC multisync color monitor.

Assuming that the credit card is valid, and that the person desiring to rent a cassette does not already have the maximum permitted number of rentals outstanding, then the computer 508 displays an array of numbers from "0" through "9" on touch screen 512, which preferably is a Tektronix TekTouch screen overlying the monitor 510. The user will be prompted via the monitor to enter a code on the screen, such as a four-digit code identifying the cassette which the person desires to rent. In the preferred embodiment of the invention the touch screen, as well as the bar code scanner 500, are connected to the computer through an RS-232 interface 513.

It is presently envisioned that the inventory of cassettes will be provided on a hard copy at the location of the machine, with a four-digit code for each cassette displayed opposite the title thereof. However, it is within the scope of the invention to program the inventory into computer memory, and to display the inventory on the color monitor 510, along with the code identifying each cassette in inventory.

Upon entering the required code the computer will display on the color monitor 510 the title of the selected cassette to be rented, the rental rate for the cassette, and if desired (e.g., in the case of a movie), the rating of the cassette (e.g., G, PG, R).

After viewing the displayed information on the monitor 510 the person will be given an opportunity to either verify that he or she wants to rent the displayed title, or that he or she wishes to cancel the selection. The user will be prompted to either verify or cancel the selection by an instruction appearing on the monitor to either touch an area of the touch screen 512 identified as "OK" (or similar designation), if the party wants to rent the displayed cassette, or to touch an area on the screen identified as "Clear" (or similar designation) in the event that the person wants to cancel the selection.

At such time as the person expresses his or her intention to rent a cassette by touching the "OK" area on the touch screen 512, the vending machine will automatically be controlled through the internal computer 508 to locate and dispense the desired videotape cassette 21.

Operation of the vending machine 10 to dispense a selected cassette 21 will now be described.

Upon verifying the selection, by the user touching the "OK" area of the touch screen 512, the computer 508 will operate motors 50 and 350 through suitable solid state relays (not shown, but identified in FIG. 11) to rotate the turret 12 to the desired rotational position, and to vertically move the elevator, and the robotic arm 14 carried thereby, to the vertical position opposite the opening in the turret in which the desired cassette to be rented is located. The optical proximity sensors 400 and 402 associated with the turret 12, and the optical proximity sensors 420 and 422 associated with the elevator assembly 60 and robotic arm 14 attached thereto, transmit signals to the computer 508 indicative of the rotational position of the turret and vertical position of the robotic arm 14. These signals, in conjunction with the coded input signal provided by the user causes the computer to control the operation of turret drive motor 50 and elevator drive motor 350 to properly position the turret 12 and robotic arm 14 relative to each other for dispensing the desired cassette 21.

In the preferred embodiment of this invention the computer is programed to first rotate the turret 12 to its desired position, and then to move the elevator assembly 60 vertically to a position in which the robotic arm 14 is opposite the desired opening 20 in the turret in which the cassette 21 to be rented is located. However, the precise order in which the turret is rotated and the elevator assembly is moved vertically does not constitute a limitation on the present invention.

After the robotic arm 14 has been positioned in the desired location opposite the turret compartment 20 in which the cassette to be rented is located, the robotic arm is moved linearly through a single, reciprocating stroke, through actuation of the low current motor 74 by the computer 508. The reciprocating stroke of the robotic arm 14 causes it to move in a direction toward the opening in the compartment 20 of the turret 12 in which the cassette is to be removed, and then in a direction away from the turret to its starting, "home" location. The proximity sensor 450 (FIG. 5) detects the linear movement of the robotic arm 14, and provides a signal to the computer 508 which causes the computer to limit operation of the low current motor 74 to permit only a single reciprocating stroke of the robotic arm.

As the robotic arm 14 is being moved in an direction toward the opening in the turret compartment, the computer 508 is programmed to energize the low current motor 130, for actuating the two sets of cassette belt drives 124, 126 to rotationally drive continuous drive belts 140, 142, 156 and 158 of the robotic arm 14 in a direction for engaging sidewalls of the videotape cassette 21, and feeding the cassette out of its turret compartment 20 and onto the supporting platform 108 of the robotic arm. The pair of proximity sensors 460, 462 on the robotic arm 14 provides a signal to the computer 508, and based upon that signal, the computer controls the operation of the motor 130 to properly position the cassette 21 on the platform of the robotic arm 14, in a location between, but not interrupting the beam emitted by the emitters 464, 468 of the spaced-apart proximity sensors 460, 462, respectively.

As the cassette 21 is being moved onto the platform 108 by operation of the low current motor 130, the bar code scanner 500 reads a bar code on the cassette 21. The purpose of scanning the bar code is to determine whether the cassette removed from the turret 12 is the correct one, i.e., the one actually selected by the user. In the event that the cassette is determined to be incorrect, the computer will be so "notified", and will reactivate the robotic arm 14 to reinsert the cassette 21 into the turret compartment from which it was removed. In addition, the coded information read by the bar code scanner 500 will be employed to correct the computer databank to thereby identify the proper title and version in the turret compartment.

In order to reinsert the videotape cassette into the compartment 20 from which it was removed, the computer 508 controls the low current, reversible motor 130 to cause the continuous belts 140, 142, 156 and 158 to rotate in a direction for moving the cassette 21 toward the turret 12. In addition, the low current motor 74 is actuated to reciprocate the robotic arm 14 through a single reciprocating cycle, to cause the robotic arm to first move toward the turret 12, and then in a direction away from the turret 12. The computer is programmed to maintain the motor 130 energized to rotate the drive belts 140, 142, 156 and 158 until the robotic arm has completed its single reciprocating cycle, at which time the computer will shut down the motor 130, and thereby stop the rotation of the drive belts.

If a cassette initially removed from a turret compartment 20 is an incorrect cassette the computer 508 then searches its database to determine whether another version or copy of the desired title is located in a different compartment of the turret. Assuming that an additional copy of the cassette is in the turret, the above described procedure for rotating the turret and vertically moving the robotic arm into a proper position for dispensing the videotape cassette from the compartment will be repeated.

If there is no additional copy of the desired videotape cassette in the machine the user will be advised of that fact by a display on the color monitor 510, and then will be prompted to either make an additional selection, or to terminate the transaction. Suitable identified locations on the touch screen 512 can be provided for this latter purpose.

Once the desired cassette to be rented has been retrieved from the turret 12 by the robotic arm 14, and the proximity sensor 450 provides a signal indicating that the robotic arm 14 has returned to its "home" position on the elevator assembly 60, the computer actuates the motor 350 to vertically move the elevator assembly 60, until the "home" position of the elevator assembly is reached, as is detected by the position locating pin 442A interrupting both sets of spaced-apart sensors 420, 422.

When the elevator assembly 60 has reached its home position, the robotic arm 14 is aligned with the discharge/access passageway 16 (FIG. 1), and the motor 130 is energized by the computer 508 to rotate the continuous belts 140, 142, 156 and 158 in a direction for feeding the cassette 21 off of the platform 108 of the robotic arm 14 and out of the discharge/access passageway.

When a renter desires to return a cassette 21 to the vending machine 10, he or she inserts the cassette into the discharge/access opening 16. In this regard it should be noted that the computer is programmed to move the robotic arm 14 into alignment with the discharge/access opening 16 after each use of the machine, so that the vending machine 10 always is in condition to receive a discharged cassette 21 to be returned.

When the cassette 21 is inserted into the discharge/access opening 16 a portion of the body thereof interrupts the proximity sensor 420 on the robotic arm, to thereby cause the belt drive system to rotate in a direction for gripping the cassette 21 and feeding it into proper position on the platform 108, between the spaced-apart proximity sensors 420, 422. As the cassette is being directed onto the robotic arm by the two sets of cassette belt drives 124, 126 the bar code scanner 500 reads the coded information on the bar code of the cassette for the purpose of ascertaining the specific cassette being returned, i.e., the title (first four digits of code) and version or copy (second four digits of code). The information read by the bar code scanner is fed into the computer 508 for comparison with the computer's data base to ascertain whether the cassette being returned is one that actually was rented from the machine, and also for identifying the location or compartment in the turret 12 in which the cassette belongs.

In the event that the bar code on the cassette is not read by the scanner 500 when the cassette is first inserted into the passageway 16, because the code is either blurred, or for some other reason, the computer is programmed to reverse the belt drive system of the robotic arm 14 to move the cassette 21 in the opposite direction, toward the discharge/access opening 16. The bar code scanner 500 again will attempt to read the coded information on the bar code, and this procedure will be repeated several times, as is determined by the computer program (e.g., five reciprocating cycles), at the end of which time a failure of the bar code scanner to read the bar code causes the robotic arm 14 to direct the videotape cassette out of the machine, through the discharge/access opening 16. At the same time the computer will prompt the user, through a message on color monitor 510, to call an identifying number, such an "800" number, for instructions regarding the return of the cassette.

Assuming that the bar code on the cassette is properly read by the bar code scanner 500, the identification of the cassette (i.e., title and version), is fed into the computer so that it can be compared with the computer's data base to determine the cassette's proper location in the turret, to thereafter cause the computer 508 to control printer 503 for giving a receipt, and to control the digital output to the high current motors 50 and 350, to thereby rotate the turret 12 and vertically move the robotic arm 14 to their proper positions relative to each other for permitting the cassette 21 to be returned to its proper compartment 20 in the turret. Thereafter, the computer will control the operation of the drive belts of the robotic arm 14 to move the cassette 21 toward the opening in the storage compartment of the turret, and the low current motor 74 will be controlled to reciprocate the robotic arm through a single reciprocating cycle, during which the robotic arm will be moved toward the opening in the compartment of the turret, and then away from said opening. The single reciprocating cycle is controlled in part by proximity sensor 450, which prompts the computer 508 to deactivate the motor 74 when the robotic arm 14 returns to its home position. The computer is programmed to operate the motor 130 for rotating the drive belt system only until the single reciprocating cycle of the robotic arm 14 is completed, at which time the cassette will have been properly inserted into the correct compartment 20 of the turret 12. Thereafter, the computer 508 energizes the motors 50 and 350 to rotate the turret 12 to its home position, and to vertically move the elevator to its home position, opposite the discharge/access opening 16.

The computer 508 preferably is connected to a main frame or host computer through suitable modem 514, such as a Super Modem 1200 baud modem. This will enable a company having one or more vending machines in the field to ascertain the status of one or more of the machines at any given time. This will enable the company to determine rental patterns from each of the machines to permit the company to optimize the inventory of videotape cassettes to be retained in the machines.

Without further elaboration the foregoing will so fully illustrate my invention that others may, by applying current or future knowledge, adopt the same for use under various conditions of service.

What is claimed as the invention is:

1. A vending machine for dispensing articles, said machine including:

(a) a rotatable turret including article retaining compartments therein, said article-retaining compartments being disposed in vertically aligned tiers, with the compartments in each tier being disposed circumferentially about the periphery of the turret;

(b) an elevator means mounted for vertical movement adjacent the turret;

(c) robotic arm means carried by the elevator means for engaging an article, said robotic arm means including an article-supporting platform, means mounting said platform for movement toward and away from said turret in a transverse direction relative to the vertical direction in which said elevator means is mounted for movement, article gripping means secured for movement with said platform in said transverse direction, said gripping means including opposed rotatable gripping members for engaging opposite sides of said article;

(d) turret drive means for rotating said turret;

(e) elevator drive means for vertically moving said elevator means;

(f) robotic arm drive means including article-supporting platform drive means for moving said platform in said transverse direction and gripping means drive means for rotating said opposed rotatable gripping members for moving a gripped article in said transverse direction onto and off of said platform.

2. The vending machine of claim 1 wherein said article to be discharged is a videotape cassette.

3. The vending machine of claim 2 including a reading means for reading coded identifying information on the cassette and providing an output signal representative of said coded information.

4. The vending machine of claim 3 wherein said reading means is mounted on the robotic arm means for reading the coded identifying information on the cassette as said cassette is being moved relative to said robotic arm means;

5. The vending machine of claim 1 including robotic arm sensing means for sensing said transverse movement of the article-supporting platform of the robotic arm means relative to said elevator means and providing a signal for controlling said transverse movement for retrieving an article from a compartment in the turret.

6. The vending machine of claim 5 wherein said robotic arm means includes article sensing means for sensing the location of an article relative to the article gripping means.

7. The vending machine of claim 6 wherein said article sensing means provides an output signal for controlling the gripping means drive means for moving the gripping means until the article gripped thereby is in a proper position on said platform.

8. The vending machine of claim 1 wherein said robotic arm means includes article sensing means for sensing the location of an article relative to the article-gripping means and for providing an output signal for controlling the gripping means drive means for moving the gripping means until the article gripped thereby is in a proper position on the article supporting platform.

9. A vending machine for dispensing articles, said machine including:

(a) a rotatable turret including article retaining compartments therein, said article-retaining compartments being disposed in vertically aligned tiers, with the compartments in each tier being disposed circumferentially about the periphery of the turret;

(b) an elevator means mounted for vertical movement adjacent the turret;

(c) robotic arm means carried by the elevator means for engaging an article, said robotic arm means including an article-supporting platform, mean mounting said platform for movement toward and away from said turret in a transverse direction relative to the vertical direction in which said elevator means is mounted for movement, article gripping means secured for movement with said platform in said transverse direction, and article sensing means for sensing the location of an article relative to said gripping means;

(d) turret drive means for rotating said turret;

(e) elevator drive means for vertically moving said elevator means;

(f) robotic arm drive means including article-supporting platform drive means for moving said platform in said transverse direction and gripping means drive means for moving the gripping means relative to said article-supporting platform to thereby move a gripped article in said transverse direction onto and off of said platform (g) control means for said turret drive means, elevator drive means and robotic arm drive means responsive to an input signal from a user of the machine for positioning said turret and robotic arm means in a predetermined location relative to each other and thereafter for moving said robotic arm means relative to said elevator means for removing an article engaged by the robotic arm means from a predetermined compartment in the turret, said control means including turret sensing means for sensing the location of the turret relative to a predetermined position and providing a first signal representative of said location; an elevator sensing means for sensing the vertical location of the elevator means relative to a predetermined position and providing a second signal representative of said vertical location, and a control section responsive to said first signal, said second signal and said input signal from the user for operating the turret drive means and elevator drive means to position said turret and robotic arm means in a predetermined location relative to each other, robotic arm sensing means for sensing said transverse movement of the article-supporting platform of the robotic arm means relative to said elevator means and providing a signal for controlling said transverse movement for retrieving an article from a compartment in the turret and for reinserting an article into a compartment of the turret; and (h) discharge passage means into which an article to be dispensed is fed from the robotic arm means, said discharge passage means also being an inlet for returning articles to the machine, said article sensing means sensing the presence of an article inserted into the discharge passage means for actuating the gripping means drive means for moving said gripping means to fed said article into proper position on the robotic arm means so that the robotic arm means can be moved with the article thereon to reinsert said article into an empty compartment in the turret.

10. A vending machine for dispensing articles, said machine including:

(a) a rotatable turret including article-retaining compartments therein, said article-retaining compartments being disposed in vertically aligned tiers, with the compartments in each tier being disposed circumferentially about the periphery of the turret;

(b) an elevator means mounted for vertical movement adjacent the turret;

(c) robotic arm means carried by the elevator means for engaging an article, said robotic arm means including an article-supporting platform, means mounting said platform for movement toward and away from said turret in a transverse direction relative to the vertical direction in which said elevator means is mounted for movement, article gripping means secured for movement with said platform in said transverse direction, said article gripping means including opposed rotatable gripping members for engaging opposite sides of said article;

(d) turret drive means for rotating said turret;

(e) elevator drive means for vertically moving said elevator means;

(f) robotic arm drive means including article-supporting platform drive means for moving said platform in said transverse direction and gripping means drive means, said gripping means drive means including means for rotating said opposed rotatable gripping members for moving a gripped article relative to the platform; and (g) said robotic arm means including article sensing means for sensing the location of an article relative to the article-gripping means and for providing an output signal for controlling the gripping means drive means for rotating the gripping members to move the article gripped thereby until it is in a proper position on the article-supporting platform.

11. A vending machine for dispensing articles, said machine including:

(a) an article storage means including compartments for receiving and retaining articles therein;

(b) an elevator means mounted for vertical movement adjacent said article storage means;

(c) robotic arm means carried by the elevator means for engaging an article, said robotic arm means including an article-supporting platform, means mounting said platform for movement toward and away from said article storage means in a transverse direction relative to the vertical direction in which said elevator means is mounted for movement, article gripping means secured for movement with said platform in said transverse direction, said article gripping means including opposed rotatable gripping members for engaging opposite sides of said article;

(d) elevator drive means for vertically moving said elevator means;

(e) robotic arm drive means including article-supporting platform drive means for moving said platform in said transverse direction and gripping means drive means including means for rotating said opposed rotatable gripping members for moving a gripped article in said transverse direction onto an off of said platform; and (f) said robotic arm including article sensing means for sensing the location of an article relative to the article gripping means and for providing an output signal for controlling the gripping means drive means for rotating the opposed rotatable gripping members until the article gripped thereby is in a proper position on the article-supporting platform.

12. The vending machine of claim 11 including robotic arm sensing means for sensing said transverse movement of the article-supporting platform of the robotic arm means relative to said elevator means and providing a signal for controlling said transverse movement for retrieving an article from a compartment in the article storage means.

* * * * *